United States Patent [19]

Long

[11] Patent Number: 4,745,840

[45] Date of Patent: May 24, 1988

[54] MODIFIED MISSILE LAUNCHER

[75] Inventor: Kenneth R. Long, Plano, Tex.

[73] Assignee: Varo, Inc., Garland, Tex.

[21] Appl. No.: 18,352

[22] Filed: Feb. 24, 1987

[51] Int. Cl.[4] ..... F41F 3/04; F41F 7/00

[52] U.S. Cl. ..... 89/1.814; 89/1.8; 89/1.819

[58] Field of Search ..... 89/1.819, 1.816, 1.53, 89/1.51, 1.58, 1.8, 1.807, 1.811, 1.814, 1.1

[56] References Cited

U.S. PATENT DOCUMENTS

| | | | |
|---|---|---|---|
| 2,940,362 | 6/1960 | Paxton | 89/1.819 |
| 3,041,937 | 7/1962 | Toomey | 89/1.814 |
| 3,088,373 | 5/1963 | Robert et al. | 89/1.814 |
| 3,228,192 | 1/1966 | Kossan et al. | 89/1.819 X |
| 3,315,565 | 4/1967 | Nash | 89/1.814 X |
| 3,593,613 | 7/1971 | Davis | 89/1.811 |
| 3,942,409 | 3/1976 | Baldwin et al. | 89/1.814 |
| 4,412,475 | 11/1983 | Hornby | 89/1.53 X |
| 4,660,456 | 4/1987 | Griffin et al. | 89/1.813 |

*Primary Examiner*—David H. Brown

*Attorney, Agent, or Firm*—Jerry W. Mills; Roger N. Chauza

[57] ABSTRACT

Disclosed is a missile launcher (142) which includes frontal electrical access to electrical apparatus mounted in the aft portion of the luncher. A connectorized extender electrical cable (66) is connected to the aft-mounted electrical apparatus (50). The other end of the cable (66) is routed internal to the launcher (142) and exits a frontal sway brace (24). A hole (108) is bored at a 30-inch launcher mounting location (28), and a connector (90) of the extender cable (66) is mounted therein. Aircraft pylons utilizing 14-inch mounting centers and frontal electrical umbilical connections can thereby utilize existing launchers modified according to the invention.

17 Claims, 2 Drawing Sheets

MODIFIED MISSILE LAUNCHER

TECHNICAL FIELD OF THE INVENTION

The present invention relates in general to missile launchers, and more particularly to modifications thereof for providing electrical access to the launcher.

BACKGROUND OF THE INVENTION

Air-to-air and air-to-ground missiles are typically attached to aircraft by equipment termed missile launchers. The launcher is adapted to be fixed to an aircraft wing or pylon, and includes a rail mechanism for slideably mounting the missile therein. The missile is held fixed within the rail until it is launched, in which event the missile is released when a sufficient amount of thrust has been developed. The missile is then thrust out of the rail.

Conventional missile launchers also house electrical apparatus for supplying power and electrical signals to the missile, prior to its launching. The missile launcher is connected to the aircraft by a number of conductors, forming an electrical cable, to allow the aircraft pilot to monitor and control the launching of the missile.

Missile launchers are typically suspended from aircraft pylon structures by two spaced apart eyebolts which are fastened to a corresponding pair of missile launcher sway braces. The eyebolts are hooked into a pair of hooks located on the pylon. Snubber apparatus fixed to the aircraft pylon is adjusted outwardly to engage the sway braces and prevent wobble of the launcher and attached missile. The other physical contact of the launcher with the aircraft is by an electrical umbilical cable which extends from the pylon and is connected to a connector fixed within the body of the launcher. Single rail launchers, commonly identified as the LAU-117/A, are constructed according to the foregoing.

Owing to the number of different types of aircraft, and thus pylon structures, and different types of missiles, numerous types of missile launchers are required. This is due in a large part to the number of different aircraft manufacturers and armament manufacturers which propose new types of structures for military use. In view that missile launchers represent a substantial expense, and in view that it is desirable to enhance the applicability or versatility of missile launchers, a need exists for adapting a single type of missile launcher for use with different types of aircraft. Particularly, there is a need to adapt a particular missile launcher having a first attachment eyebolts spacing and electrical connection location, to another aircraft type of pylon having a different configuration of physical and electrical connections.

SUMMARY OF THE INVENTION

In accordance with the present invention, the disclosed missile launcher apparatus and method of fabrication thereof reduces or substantially eliminates the disadvantages and shortcomings associated with the prior launcher devices. According to the missile launcher of the invention, remote electrical access to the electrical apparatus of the launcher is made via a frontal sway brace structure, rather than by a connector fixed rearwardly in the body of the launcher.

A cable extender is provided for extending the length of a short section of cable which is typically supplied with the electrical apparatus of the launcher. The connectorized end of the short section of cable is connected within the missile launcher to a connectorized end of the cable extension. The opening in the body of the launcher in which the connector of the short cable section was previously fixed, is sealed with a cover plate to prevent moisture from entering the launcher.

One conductor of the extender cable is broken out and is connectorized for connection to another small cable directed to a missile restraint device. The missile restraint device in the launcher releasably fixes the missile to the launcher. Power from the aircraft directed through the extender cable and rerouted to the small cable is effective to control the missile restraint device and thus the launching of the missile.

The frontal sway brace, which includes a first and second threaded hole which provides a 14-inch and 30-inch mounting center with corresponding holes in an aft sway brace, is modified. A bore is formed in the foremost mounting center of the frontal sway brace for fixing therein an electrical connector. A bore of sufficient size is also formed in that part of the body launcher which is in vertical registry with the sway brace bore. In this manner, the cable extension is routed internal to the launcher and connected to the sway brace connector. An aircraft multiconductor cable is then connected to the frontal sway brace connector, thereby effecting connections to the electrical assembly. As a result, an aircraft pylon with 14 inch mounting centers and with a forwardly located electrical connector can utilize a missile launcher intended for use with other types of aircraft.

BRIEF DESCRIPTION OF THE DRAWINGS

Further features and advantages will become more apparent from the following and more particular description of the preferred embodiment of the invention, as illustrated in the accompanying drawings in which like reference characters generally refer to the same parts throughout the views, and in which.

DETAILED DESCRIPTION OF THE INVENTION

Figure 1:
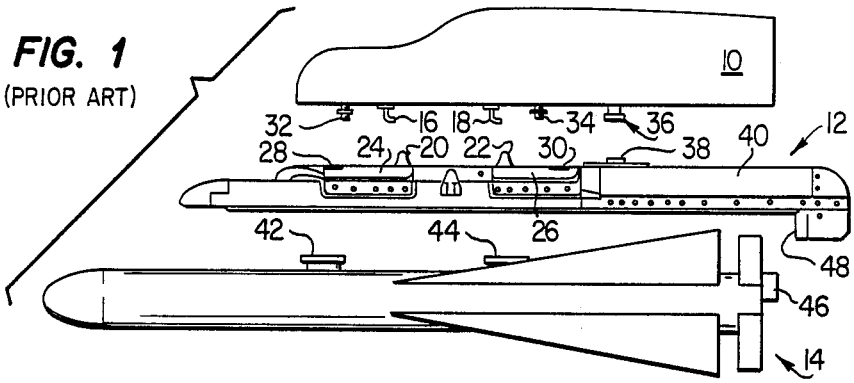
FIG. 1 (PRIOR ART)
FIG. 1 is a side elevational view of an aircraft pylon, a missile launcher, and a missile, all of the type well known in the art.

In order to appreciate the novel features of the invention, there is first illustrated in FIG. 1 aircraft missile apparatus commonly employed for attaching a missile to an aircraft. Specifically illustrated is an aircraft pylon 10, a launcher 12, and a missile 14. The pylon 10 includes a pair of hooks 16 and 18 for attachment to an associated pair of eyebolts 20 and 22 which are fixed atop the launcher 12. The eyebolts 20 and 22 are fixed at 14-inch centers within respective sway braces 24 and 26. 30-inch mounting centers in the sway braces are indicated at reference characters 28 and 30. When the eyebolts 20 and 22 are engaged within the pylon hooks 16 and 18, fore and aft adjustment screws 32 and 34 are adjusted outwardly for engagement with the sway braces 24 and 26. An additional pair of adjusting screws (not shown) are provided on the opposing undersurface of the pylon 10 and are also adjusted outwardly against the sway braces 24 and 26 to prevent the launcher 12 from swinging or wobbling about pylon hooks 16 and 18.

Aircraft with the type of pylon 10 indicated in FIG. 1 are provided with an umbilical electrical cord and connector 36 for aft attachment to a missile launcher connector 38 fixed within the body 40 of the missile launcher 12. When the physical and electrical connections are established between the pylon 10 and the missile launcher 12, an integral structure is provided for mounting of the missile 14.

The missile launcher 12 includes on its undersurface thereof a T-shaped rail (not shown) extending substantially the entire length of the launcher 12. The missile 14 includes an associated pair of T-slotted hangers 42 and 44 for slideable engagement with the rail of the launcher 12. Electrical and other mechanical connections between the missile launcher 12 and the missile 14 are provided by interface equipment 46 and 48. Thus, when the slotted hangers 42 and 44 of the missile 14 are loaded into the rail of the launcher 12, and moved toward an aft position, interface connections 46 and 48 become mated to thereby provide the necessary physical and electrical connections. In this manner, the missile launcher 12, as well as the missile 14, is electrically connected to the aircraft through the umbilical connector 36.

A missile restraint device (not shown) within the launcher 12 functions to hold the frontal missile hanger 42 (FIG. 1) fixed with respect to the launcher rail until sufficient rocket thrust has been developed within the engine of the missile. When the requisite amount of thrust has been developed, the restraint device releases the missile hanger 42, thereby allowing the missile 14 to be propelled under its own power out of the launcher rail.

Figure 2:
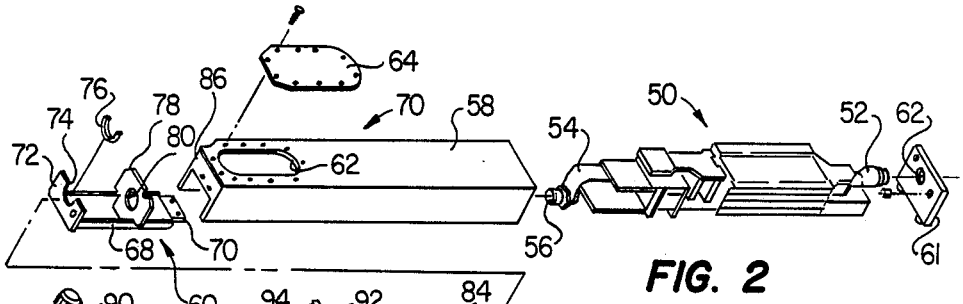
FIG. 2 illustrates the improved connections to the electrical apparatus of a launcher, with the parts broken away for clarity.

The missile apparatus illustrated in FIG. 2 comprises an LAU-117/A missile launcher constructed for holding a Maverick-type missile attachable to an F-4 military aircraft. There are situations, however, in which it is desired to utilize the LAU-117/A missile launcher for attaching a Maverick-type missile to an F-5E/A-4 aircraft, without requiring the design and construction of another type of missile launcher. With this new need, the 14-inch launcher mounting center is required, and an electrical interface to the launcher 12 is required at the front thereof.

According to the invention, as below described, a novel adaptation of the LAU-117/A missile launcher is disclosed for utilization thereof in connection with an additional aircraft type.

FIG. 2 illustrates the electrical apparatus of the launcher, broken apart for clarity of understanding. The power supplies and electrical monitor equipment of the launcher electrical apparatus is indicated generally as reference character 50. Connected to the electrical apparatus 50 is a connectorized multi-conductor cable 52 which is extended to the missile 14 via the interface connectors 46 and 48 (FIG. 1). A short section of another multi-conductor cable 54 is also connected to the electrical apparatus 50. The short cable 54 includes a 46-pin connector 56. The electrical assembly 50 is contained within a housing 58, which housing is fixed by fastening hardware to the missile launcher.

The housing 58 includes an adapter bracket 60 fastenable thereto for cable routing and anchoring purposes. In the top of the housing 58 there is formed an access opening 62 and a cover plate 64 which, in prior applications, held the connector 56 attached to cable 54. According to the invention, the cover plate 64 is formed as a cover for sealing the opening 62. A gasket, or other suitable sealing material such as RTV, is utilized between the cover plate 64 and the housing 58 for sealing such elements together.

Fastened to the front part of the housing 58 is the adapter bracket 60 for anchoring the connector 56 associated with the short cable section 54, and for anchoring an extender cable 66 within the body of the missile launcher 12. The adapter bracket 60 includes a tray-like frame 68 with a flange 70 formed at its rear end for fastening with screws to the bottom of the housing 58. A front plate 72 is made integral with the frame 68 and includes an opening 74 with grommet cushion 76 in which the extender cable 66 rests. The front plate 72 further includes a D-shaped hole for mounting therein a connector for a missile restraint cable. A connector anchor bracket 78 is fixed within the midsection of the frame 68. The anchor bracket 78 includes an opening 80 for mounting therein a panel-type connector 82. The panel-type connector 82 is constructed with a plate 84 for mounting with screws to the anchor bracket 78. The screws which mount the panel-type connector 82 to the anchor bracket 78 also fix the anchor bracket 78 to a front face 86 of the housing 58. The panel connector 82 is of the type which has electrical connection pins at both ends thereof for mating with the socket-type connector 56 of the short cable 54 and with a socket-type connector 88 of the extender cable 66.

The extender cable 66 further includes a pin-type connector 90 terminating the conductors at the end thereof which is fixed to the frontal sway brace 24. The pin-type connector 90 and the socket type connector 88 include threaded sleeves for providing a screw connection to other mating connectors. The extender cable 66 further includes a conductor 92 broken away from the main cable (not shown) which is typical equipment of the LAU 117/A launcher. The conductor 92 is terminated with a slip-type connector 94.

According to the invention, it can be seen that the connector 56 of the short cable section 54 is removed from its prior fixed position in the top of the housing 58, and is internally connected to the adapter 60 in the frontal part of the housing 58. In this manner, the cable 54 and connector 56 remain internal to the launcher 12. The electrical conductors forming the cable 54 and contacts within the connector 56 are extended forwardly by the connectorized extender cable 66. Extender cable 66 provides a one-to-one extension of each of the conductors within the cable 54. The extension cable 66 and short cable 54 are connected through the pylon 10 by connectorized cable (not shown) to the cockpit of the aircraft. The aircraft pilot can thus control the launcher equipment and the missile 14 by electrical signals transmitted through the conductors of the various cables.

Figure 3:
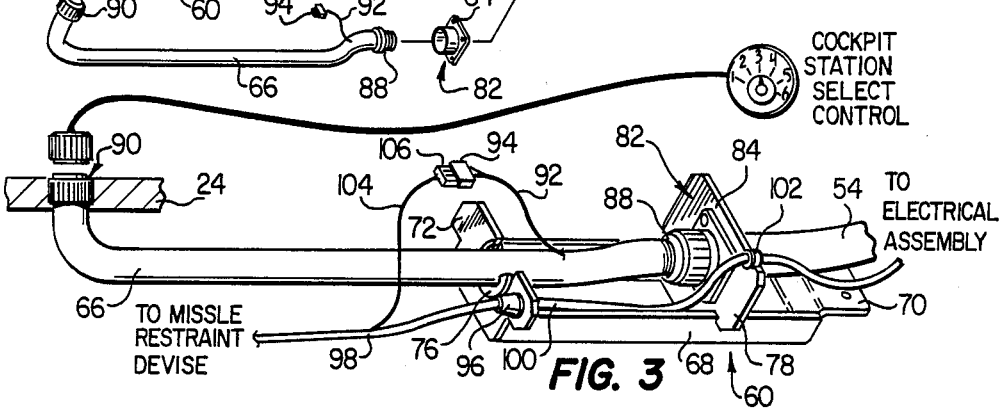
FIG. 3 illustrates an assembled missile launcher, with a section thereof broken away to illustrate the electrical cable routing therethrough.

FIG. 3 depicts the electrical cable interconnection arrangement for providing remote electrical access to the electrical apparatus 50. As can be seen, the multiconductor extender cable 66 is fixed at its one end by connector 88 fastened to the frontal portion of the housing 58 by the anchor bracket 78. The extender cable 66 is routed around the missile restraint device and connected at its other end by fixing the connector 90 within the sway brace 24. When routed along this path, the length of the extender cable 66 is about four feet long. In order to minimize external electrical interference with the conductors of the cable 66, such conductors comprise twisted pairs or shielded conductors. While not shown, the extender cable 66 can be formed split in the middle, with each section routed on opposing sides of the missile restraint device.

More specifically, the electrical interconnection arrangement shown in FIG. 3 illustrates the detailed cable anchor and routing technique for providing the remote electric access to the electrical apparatus of the launcher 12. The remote end of the extender cable 66 is fixed by fastening the connector 90 in the frontal sway brace 24. The front plate 72 of the cable adaptor bracket 60 includes the grommeted opening 76 for supporting the cable 66. Also, the front plate 72 has fixed within the D-shaped hole a connector 96 for electrically mating the missile restraint device (MRD) cable 98 to another cable section 100 which is extended to the electrical assembly 50. MRD cable sections 98 and 100 can thus be separated by the connector arrangement at the front plate 72. MRD cable section 100 is also supported by a grommet 102 as it passes through the anchor bracket 78.

The extender cable 66 is anchored to the anchor bracket 78 by a screw-type connector 88 fastened to the panel-type connector 82. The electrical assembly cable 54 is also anchored to the anchor bracket 78 by fixing the connector 56 to the panel-type connector 82. Like the extender cable 66, the MRD cable 98 has formed therewith a conductor 104 broken away and terminated with a slip-type connector 106. Connectors 94 and 106 are matable for providing continuity of a conductor between the extender cable 66 and the MRD cable 98. Importantly, conductor 92 is extended to the remote end of extender cable 66 and appears as a pin in connector 90. Conductor 104 is extended to the missile restraint device through MRD cable 98. As a result, pilot cockpit controls are electrically connected to the missile restraint device.

Normally the pilot has available a "station select" control for selecting which missile to activate and fire. On the proper switching of the station select switch, a particular missile is selected, and the missile restraint device is actuated for allowing the missile to be launched when a sufficient amount of thrust therein has been developed. Heretofore, the actuation of the station select switch only selected the particular missile, without actuation of the missile restraint device. In prior systems, when the pilot activated a switch to explosively remove a missile dome cover to expose a video camera, the missile restraint device was then activated. Conductors 92 and 104 carry 28 volts DC for activating the missile restraint device in the manner noted.

Figure 4:
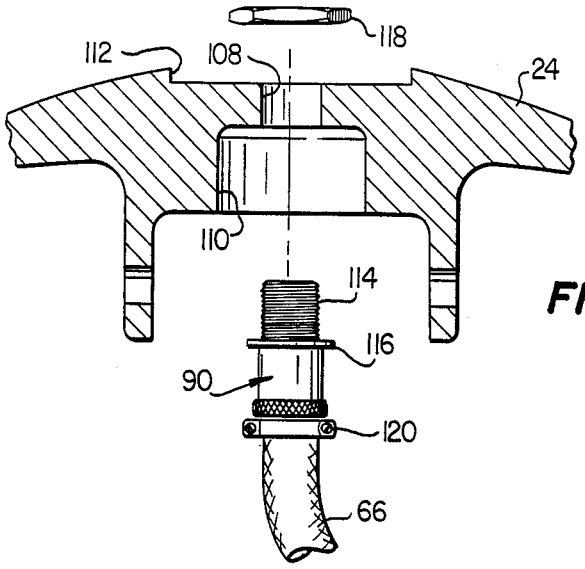
FIG. 4 is a sectional view of the frontal sway brace modified for fitting with an electrical connector.

FIG. 4 illustrates a cross-sectional view of the frontal sway brace 24 machined for fixing the remote end of the extender cable 66 thereto. The extender cable 66 is fixed at a location in the sway brace 24 normally occupied by a 36-inch pylon mounting center. A D-shaped bore 108 is formed in such location in the sway brace 24 from the top surface thereof to the underlying cavity 110. A second, more shallow hole 112, is machined within the top surface of the sway brace 24, in co-axial alignment with the D-shaped bore 108. The extender cable connector 90 having an externally threaded and also D-shaped sleeve 114 is inserted through the D-shaped bore 108 until stopped by a stop flange 116 fixed to the connector 90. A nut 118 is then screwed onto the threaded sleeve 114 and tightened. The nut 114 and a major part of the threaded sleeve 114 are disposed within the well 112 and thus do not extend significantly beyond the upper surface of the sway brace 24. The connector 90 is of the type having a strain relief 120 for supporting the cable and preventing sharp bends.

Figure 5:
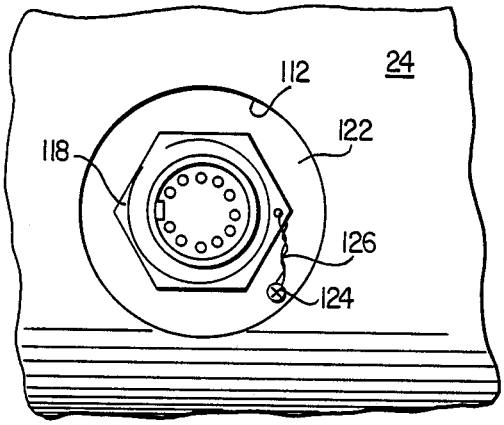
FIG. 5 is a top view of the frontal sway brace.

FIG. 5 is a top view of a portion of the frontal sway brace 24 illustrating the relative position and size of the parts. The shallow well 112 formed within the top surface of the sway brace 24 includes a boss surface 122 with a small threaded hole formed therein for securing a screw 124. The screw 124 is fixed to a locking wire 126 which is threaded through a hole in the nut 118. The connector nut 118 is thus prevented from turning and becoming loosened due to vibration.

Figure 6:
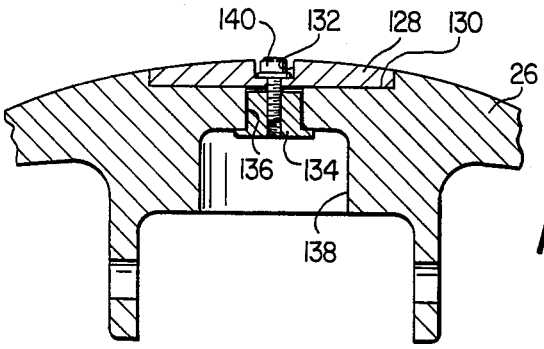
FIG. 6 is a sectional view of the aft sway brace with the 36-inch mounting center hole plugged.

FIG. 6 illustrates the rear sway brace 26, modified to seal the 36-inch mounting center conventionally formed therein. A circular insert 128 is formed for fitting within the recess 130. The insert 128 itself has formed therein a recessed area 132 with a hole therein. A flanged cap 134 is used to fill the bottom depression 136 within the cavity 138. The insert 134 also includes a threaded hole therethrough. The circular insert 128 and the cap 134 are coated with a sealing material, such as RTV, and an allen-head bolt 140 secures the parts together as shown in FIG. 6. The 36-inch mounting center is thus sealed to maintain moisture from entering the missile launcher.

Figure 7:
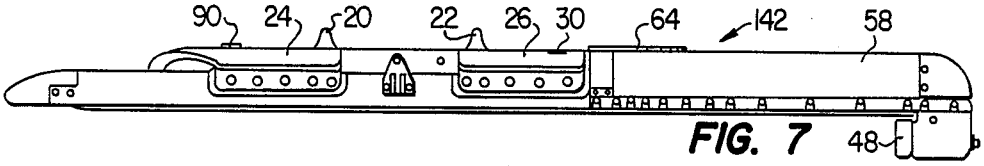
FIGS. 7 and 8 are respective side elevational and top plan views of the missile launched constructed in accordance with the invention.
Figure 8:
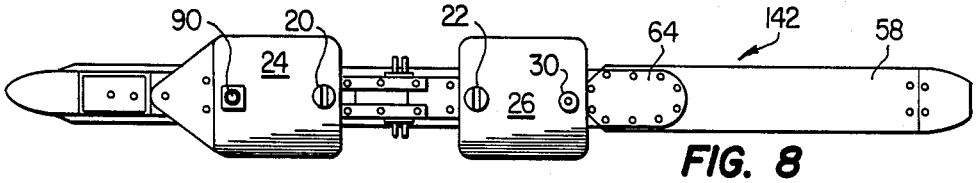

The missile launcher 142 constructed in accordance with the invention is further illustrated in FIGS. 7 and 8. The extender cable connector 90 protrudes a small amount above the surface of the sway brace 24 for allowing easy connection to the umbilical cable connector (not shown) fixed within the frontal portion of F-5E/A-4 aircraft pylons. As noted above, these types of aircraft utilize the eyebolts 20 and 22 which are spaced apart about 14 inches. The forward 30-inch mounting center is not utilized, and thus such position is conveniently used for fixing therein the extender cable connector 90 to provide frontal external access to the electrical apparatus located in the back portion of the modified LAU-117 launcher 142.

From the foregoing a new missile launcher structure has been disclosed which allows prior developed launchers to be modified or constructed to accommodate different applications. Particularly, in order to provide electrical access in the frontal portion of the launcher to the electrical apparatus mounted in the aft section of the launcher, a unique modification is undertaken. The connector of the electrical apparatus which was heretofore mounted in the aft body section of the launcher is removed therefrom, and fixed internal to the launcher. A connectorized cable extender is fixed to the internally mounted connector of the electrical apparatus, and routed to the frontal part of the missile launcher. A bore is formed through the frontal sway brace and the underlying body portion of the launcher, and the connectorized end of the extender cable is fixed within the sway brace. The bore is formed in the 30-inch mounting center of the sway brace so that the adjacent 14-inch mounting center used by the aircraft of interest is not affected. Electrical access in the frontal part of the missile launcher to electrical apparatus mounted in the rear section of the missile launcher is thereby achieved.

While the preferred embodiment has been disclosed with reference to a specific missile launcher method of modification and structure thereof, it is to be understood that many changes in detail may be made as a matter of engineering choices without departing from the spirit and scope of the invention, as defined by the appended claims.

What is claimed is:

1. A missile launcher having an elongate body and means for removable attachment thereto of a missile, and a pair of sway braces having two pairs of mounting centers for attaching to aircraft of different types, said sway braces being of the type which extend outwardly beyond the body of the launcher for abutment with the aircraft, and electrical apparatus connectorized cable means for connecting to the aircraft, the improvement comprising:

a cable extender connected to the connectorized cable means for extending the length of the connectorized cable means;

one said sway brace having a bore formed therein; and a connector fixed in said sway brace bore and connected to said cable extender for providing electrical access from the aircraft to the launcher through said sway brace.

2. The missle launcher of claim 1 further including means for sealing said connector in said sway brace.

3. The missile launcher of claim 1 wherein said cable extender includes conductors routed in a pair of separated bundles.

4. The missile launcher of claim 1 wherein said bore is located at one said mounting center.

5. The missile launcher of claim 4 wherein said bore is formed in a forward-most mounting center position.

6. The missile launcher apparatus of claim 1 further including a strain relief means for anchoring said cable extender to said launcher.

7. The missile launcher of claim 6 wherein said strain relief means is located at the end of said cable extender which is connected to said connectorized cable.

8. The missile launcher of claim 6 wherein said cable extender includes a conductor broken away therefrom and connected to a missile restraint device housed in said missile launcher.

9. The missile launcher of claim 6 further including a bracket adaptor having a cable means connector fixed therein for coupling with a connector which is fastened to said cable extender.

10. The missile launcher of claim 9 wherein said bracket adapter includes a cushioned support for supporting a portion of said cable extender.

11. A method for modifying a missile launcher to provide electrical access from an aircraft to electrical apparatus fixed remotely within said launcher, comprising the steps of:

extending the length of an electrical cable connected to said electrical apparatus;

boring a hole in a sway brace which is fixed to a top surface of said missile launcher;

routing the extended cable within the launcher to said bore; and fixing a connector in the bore of the sway brace and connecting a number of conductors of said cable to a corresponding number of lugs of said connector such that the aircraft can be electrically connected to said launcher through said sway brace.

12. The method of claim 11 further including routing a conductor through said electrical cable to a missile restraint device.

13. The method of claim 12 further including extending said conductor external to said electrical cable so as to be accessible for signaling at an aircraft cockpit location.

14. The method of claim 13 further including connecting said conductor to a station select switch in said cockpit used for selecting one of a number of missiles for launching.

15. A method for providing electrical access to a missile launcher of the type having an elongate launcher body and a rail for slideable attachment thereto of a missile, electrical apparatus fixed within said launcher, and a sway brace for stabilizing said launcher with respect to an aircraft, comprising the steps of:

fixing a connector in said sway brace; and connecting an electrical cable from said connector to said electrical apparatus.

16. The method of claim 15 further including fixing said connector in said sway brace at a location normally utilized for fixing said sway brace to the aircraft.

17. The method of claim 15 further including sealing said connector to said sway brace to prevent moisture from entering said launcher through said connector.

* * * * *